United States Patent [19]

Travers et al.

[11] Patent Number: 4,484,048

[45] Date of Patent: Nov. 20, 1984

[54] PROCESS AND APPARATUS FOR THE HOMOGENEOUS, ELECTROMAGNETIC INDUCTION HEATING WITH TRANSVERSE FLUX OF CONDUCTING AND NON-MAGNETIC FLAT PRODUCTS

[75] Inventors: Roger Travers, Chatenay-Malabry; Jean-Paul Camus, Mantes-La-Jolie; Jean-Claude Bronner, Rueil-Malmaison, all of France

[73] Assignee: CEM Compagnie Electro-Mecanique, Paris, France

[21] Appl. No.: 396,050

[22] Filed: Jul. 7, 1982

[30] Foreign Application Priority Data

Jul. 10, 1981 [FR] France ..... 81 13689

[51] Int. Cl.[3] ..... H05B 6/00

[52] U.S. Cl. ..... 219/10.43; 219/10.61 R; 219/10.67; 219/10.77; 219/10.79

[58] Field of Search ..... 219/10.41, 10.43, 10.57, 219/10.61 R, 10.71, 10.73, 10.67, 10.75, 10.77, 10.79

[56] References Cited

U.S. PATENT DOCUMENTS

| | | | |
|---|---|---|---|
| 2,448,009 | 8/1948 | Baker | 219/10.41 |
| 2,556,223 | 6/1951 | Schnure, Jr. | 219/10.41 |
| 2,902,572 | 9/1959 | Lackner et al. | 219/10.41 |
| 3,041,434 | 6/1962 | Alf | 219/10.41 |
| 3,781,506 | 12/1973 | Ketchum et al. | 219/10.41 |
| 4,054,770 | 10/1977 | Jackson et al. | 219/10.61 R |
| 4,122,321 | 10/1978 | Cachat | 219/10.41 |
| 4,307,276 | 12/1981 | Kurata et al. | 219/10.41 |
| 4,321,444 | 3/1982 | Davies | 219/10.71 |

FOREIGN PATENT DOCUMENTS 909873 9/1972 Canada ..... 219/10.41

*Primary Examiner*—C. L. Albrtton
*Assistant Examiner*—M. M. Lateef
*Attorney, Agent, or Firm*—Burns, Doane, Swecker & Mathis

[57] ABSTRACT

A process and apparatus for inductive heating of flat, thin, conductive, nonmagnetic products of variable dimensions. A plurality of currents are inductively generated in the product in such a way that elementary current arrays are formed in the product in both the longitudinal and lateral directions. Current arrays of local heating heterogeneity, each comprising at least one of the elementary current arrays, are defined, and the intensities of the inductively generated current in the arrays of local heating heterogeneity are controlled as a function of the volume of the array of local heating heterogeneity with which they are associated, so that the average value of power dissipated per unit volume in each array of local heating heterogeneity is approximately the same as for all other arrays. The apparatus specifically includes an inductor with individually controllable coils (poles) arranged to extend longitudinally and laterally over the area of the product to be heated. The positions of the boundaries of the product, together with other product data and desired heating data, are used to control the individual coils of the inductor so as to control the currents induced in the product as a function of the relative positions of the product boundaries and the individual coils.

13 Claims, 9 Drawing Figures

PROCESS AND APPARATUS FOR THE HOMOGENEOUS, ELECTROMAGNETIC INDUCTION HEATING WITH TRANSVERSE FLUX OF CONDUCTING AND NON-MAGNETIC FLAT PRODUCTS

BACKGROUND OF THE INVENTION

The present invention relates to a process and apparatus for the homogeneous heating of thin, conducting and nonmagnetic products of variable dimensions through the use of a transverse electromagnetic flux.

Processes and devices for the electromagnetic induction heating of thin products with transverse flux are known. Such known processes and devices insure a relative homogeneity of heating only by the advance of the product, which reduces their application to strip.

Furthermore, in one known system, control of heating as a function of width is effected mechanically. Temperature differences generated in the course of heating are large and may result in deformations of the product. In other known systems, there is no regulation of the homogeneity of heating over the width.

OBJECTS AND BRIEF SUMMARY OF THE INVENTION

The principal object of the present invention is to effect the homogeneous heating at rest of a flat product having two finite dimensions, regardless of the magnitude of the dimensions, for example in the course of the manufacture of a range of sheet metal.

Relatively simple arrangements also are provided for the appropriate adaptation of the process to a displacement of the sheet or to the use of the technique for the heating of a strip, for example.

In accordance with the invention, heating is obtained by the principle of transverse flux, electromagnetic induction as applied to conducting, nonmagnetic products.

The present invention is concerned more particularly with a process for the transverse flux, electromagnetic heating of conducting, nonmagnetic, flat products in order to obtain a homogeneity of temperature, characterized by:

generating in the product, currents included inside elementary arrays of juxtaposed currents, and defining arrays of local heating heterogeneity, each comprising at least one of the elementary arrays, and regulating the intensity of each of the currents as a function of the volume of the array of local heating heterogeneity to which such currents correspond, in a manner such that the average value of power dissipated per unit volume in each array, including the arrays of local heating heterogeneity, is the same over the entire product.

The process according to the invention further includes:

using means to create an alternating magnetic field, said means being designated inductors and consisting of conductors forming current loops; and controlling the intensities traversing these conductors such that at least some of the currents are controlled independently to each other so that the control of one with respect to another is a function of at least one of the dimensions of the product.

The process according to the invention further includes, depending on the situation:

determining the position of the product with respect to the inductor and, particularly, its boundaries with respect to the inductors;

defining the rise in temperature to be effected;

employing a computer;

providing the temperature rise and position data to the computer to derive the values of the current intensities to be circulated in the different poles of the inductors as a function of the characteristics of the product and the heating desired;

controlling, by the values of the current intensities calculated and through the use of a source which may be variable in frequency, the current intensities of each pole or group of poles of the inductors.

The invention further concerns an apparatus for the electromagnetic alternating transverse flux heating of conducting, nonmagnetic, flat products in order to obtain a homogeneity of temperature, comprising at least one inductor, which consists of conductors forming a lattice of current loops and a magnetic circuit reinforcing the effectiveness of the apparatus, which effects the process according to the invention and is characterized in that it further comprises:

means to determine the position of the product with respect to the inductor and, particularly, the position of its boundaries;

means to define the rise in temperature to be effected;

means to observe the temperature of the product;

means connected to the position determining, temperature defining and temperature monitoring means to determine the current intensities to be circulated in the different loops of the inductors as a function of the characteristics of the product and the heating desired;

means connected with the current determining means and with the inductors capable of generating the current intensities determined in this manner.

BRIEF DESCRIPTION OF THE DRAWINGS

Further characteristics and advantages of the present invention will become apparent from the description hereinafter with the aid of the drawings attached hereto, wherein:

FIGS. 5 and 5A are block diagrams illustrating the operation of the devices according to the invention;

DETAILED DESCRIPTION

Figure 1:
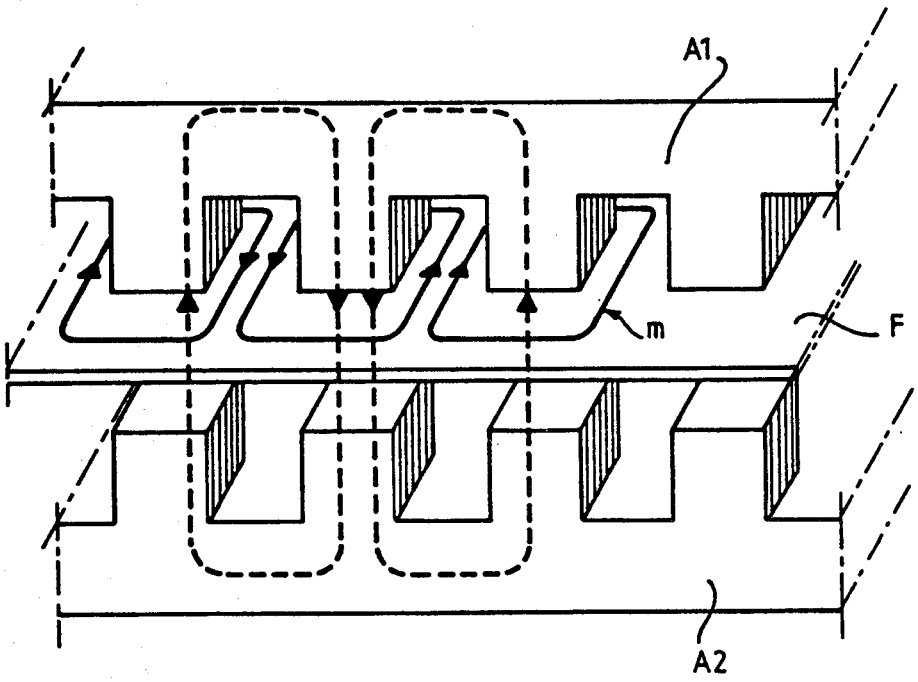
FIG. 1 is a perspective view in part of a form of embodiment of the invention consisting of a heating installation comprising two inductor arrangements placed on either side of the product to be heated.

The process according to the invention comprises the generation of currents (m) in the product, the currents being within arrays having dimensions and configurations resulting from the spatial variations of alternating magnetic fields to which the product is exposed. The intensities of the currents in each array are controlled such that the average value of the power dissipated per unit volume in each array is the same over the entire product.

Local heating homogeneity within each current array is insured by conduction and depends directly on the size of the array.

The boundaries (ends and edges), in general, are not compatible with a predetermined spatial distribution of the magnetic field, as the dimensions of the product are variable or the expansion due to heating causes an appreciable variation of said dimensions. At the boundaries, therefore, the elementary current arrays generated are not always those which would exist in the case of an infinite product.

For an identical magnetic field current of excitation (b), the average power per unit volume dissipated in one of these boundary arrays is different from that dissipated in an infinite product. Moreover, certain arrays close to the boundary arrays may be perturbed. Such arrays are therefore referred to herein as arrays of local heating heterogeneity.

In an infinite product, an array of local heating heterogeneity always merges with the elementary array of induced current (m). In other words, there are no edge induced distrubances and the arrays are all homogeneous as discussed herein.

According to the present process for heating finite products, in order to obtain the same average value of the heating power per unit volume in the elementary arrays of the boundaries as in the reset of the product, arrays of local heating heterogeneity along the boundary, each comprising one or several juxtaposed elementary arrays, are defined. The control of the power dissipated in each array of local heterogeneity is effected by the regulation of the intensity of current loops (b) facing this array of local heterogeneity thus defined.

According to a particular embodiment, each array of local heating heterogeneity is defined by an elementary array. The current loops of the inductor not facing the product, i.e., those inductor loops having no part of the product directly over or under them, are extinguished or deenergized.

An apparatus embodying the process according to the invention comprises:

means (A) to generate an alternating magnetic field, preferably inductors, that comprises conductors which form current loops traversed by variable current intensities and magnetic circuits enhancing the effectiveness of the device; and, depending on the specific case:

means (B) to determine the position of the product with respect to the inductor and, in particular, the position of its boundaries;

means (C) to define the rise in temperature to be effected;

means (D) to monitor the temperature of the product;

means (E) connected with the aforementioned means to determine the current intensities to be circulated in the different "loops" of the inductors as a function of the characteristics of the product (F) and the heating effect desired;

means (G) possibly connected with the latter and with the inductors, capable of generating the intensities determined in this manner.

Figure 4:
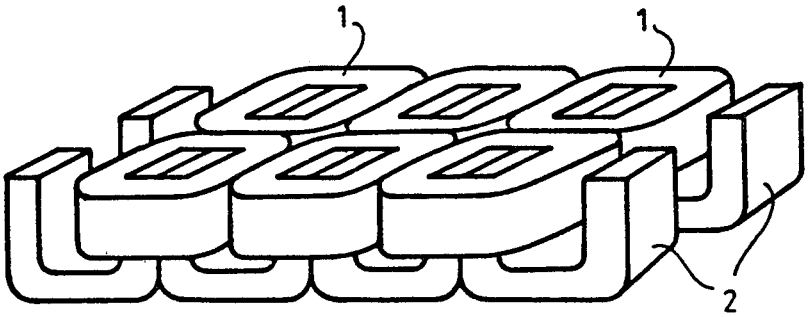
FIG. 4 is a perspective view of the inductor windings associated with a magnetic circuit to close the magnetic flux.
Figure 2:
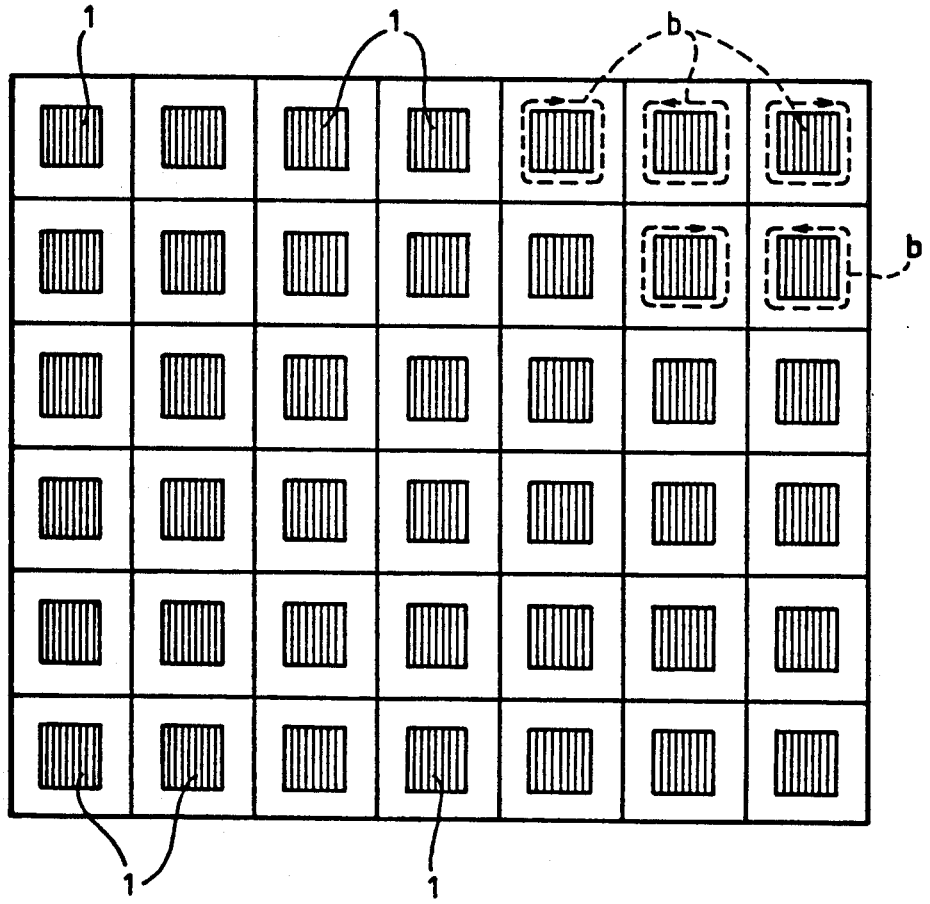
FIGS. 2 and 3 are plan views of the windings of one of said inductors, respectively without the product and with the product.
Figure 3:
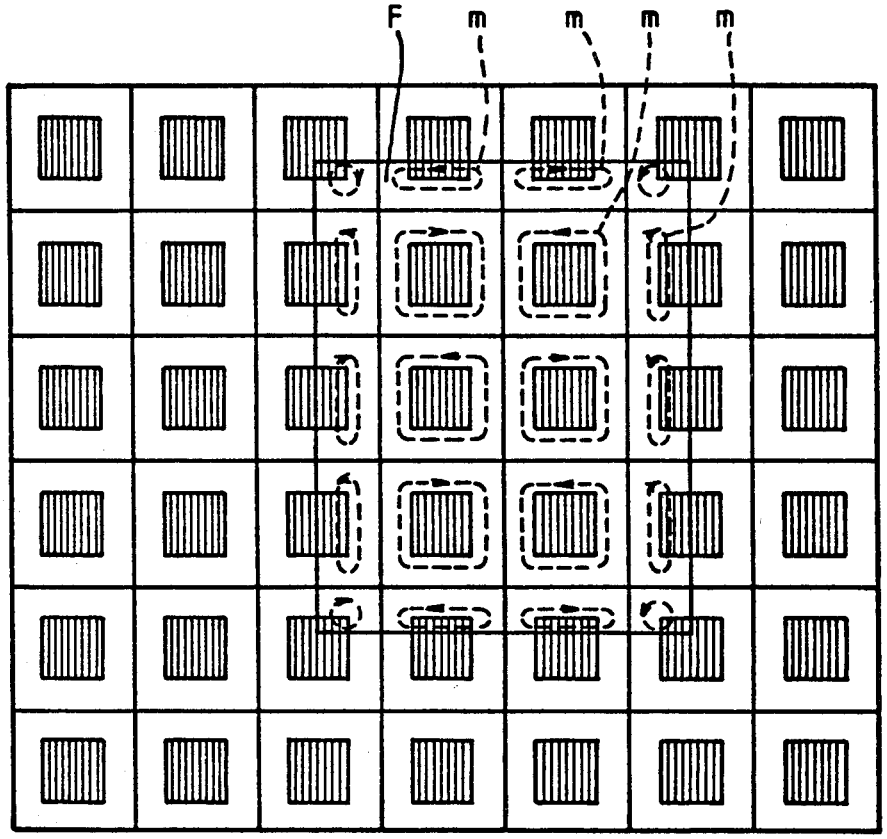

In a preferred form of embodiment of the invention, the heating device comprises identical, horizontal inductors (A1 and A2) facing each other, placed on both sides of the product (F) to be heated (FIG. 1). Each of the inductors comprises conductor windings (1) of a square configuration, placed regularly in accordance with an identical polar pitch in two orthogonal directions. In each of these directions, at each given instant, the current loops (b) of the conductor windings formed in this manner constitute a succession of alternating North and South magnetic poles (FIGS. 2 and 3). The closure of magnetic fluxes, to reinforce the efficiency of the apparatus, is insured by a magnetic circuit (2), possibly of a laminated construction. This closure may be effected in one of the aforementioned directions as illustrated, or both, if desired. Closure in a single direction renders the control of the variation of the profile of the field in the orthogonal direction simpler, as the interactions between poles of two lines parallel to the direction to the closures are weaker (FIG. 4).

The size of the pole is conventionally determined as a function of the maximum heating power per unit volume to be obtained, the thermal conductivity of the product and the maximum temperature difference permissible in the product during heating. However, the temperature differences in the product may be reduced, at the termination of the heating, by a reduction of the power per unit volume to which the termination differences are proportional in the first case.

The frequency of the power supply of the apparatus conforms to two objectives:

an appreciable improvement of yield in the case where the industrial frequency is not adopted;

electromagnetic support of the product treated, each of which may be of different thickness, resistivity and specific gravity. Adjustments of the frequency may thus be necessary to take into account variations of these parameters.

The aforedescribed variation of the magnetic field further provides a stable support of the product between the inductors.

Displacement of the product with respect to the inductors may be obtained by varying the profile of the magnetic field (reduction of intensity in the direction of the displacement) or by the addition of windings to constitute a linear, triphase motor, the latter devices being known in themselves.

The position of the product with respect to the inductors is known, for example by its entry position and the displacements effected.

Figure 5A:
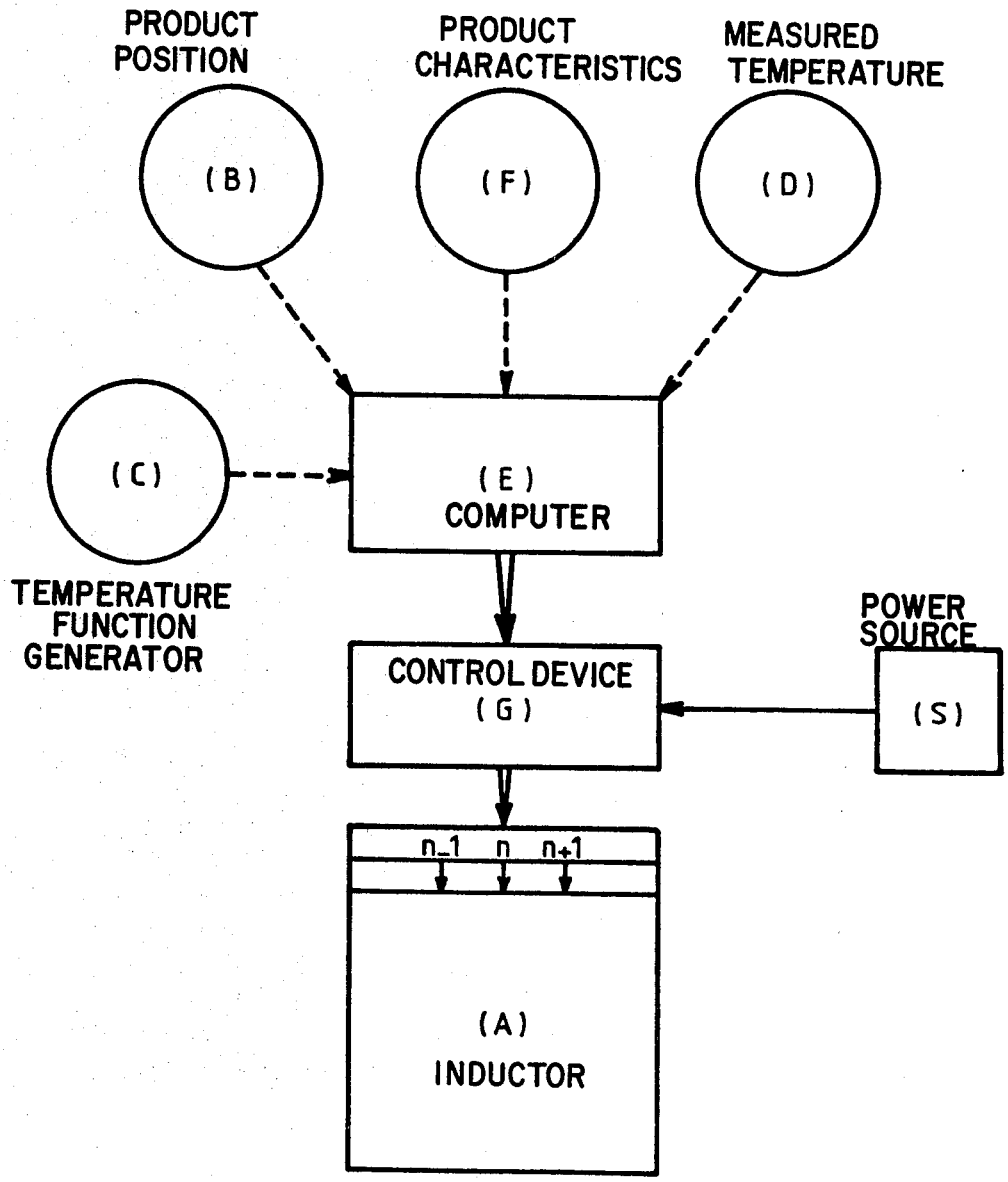

From the position of the product (B, FIG. 5), in particular the position of its boundary with respect to the poles of the inductor, and from the characteristics of the product, a computer (E) derives the value of the current intensities that must be passed through the poles to obtain homogeneous heating. These current intensities are substantially equal over the major portion of the product; they are different only for the poles close to the boundaries of the product. In the case of products much longer than wide, the embodiment may be simplified by controlling only the series of poles parallel to the edges of the product, with the relative variations in intensity thus concerning only two or three rows along each side edge of the product.

From the value of the intensities calculated, the current intensities in each pole or group of poles are regulated by a suitable control device (G) connected to a source (S), the frequency of which may be variable.

The rise in temperature desired may be obtained from entry in the computer (E) of a stored record of the temperature desired (C) and a measurement of the actual temperature (D) of the product, which values are compared by the computer (E).

In another embodiment (FIG. 5A), a function generator develops the mean desired temperature function of the product with respect to time and this temperature function is stored or used as it is developed. The computer (E) compares this temperature function record (C) with a temperature of the product calculated by the summation or integration of the heating already effected, to furnish the current intensity parameters required to obtain the temperature function desired.

To complement this approach, the calculated temperature may be compared with a measure of the actual temperature of the product to avoid slow integration drifting, or actual temperature may be used for direct control thus providing an automatic adaption of the mathematic heating model used by the computer.

Figure 6:
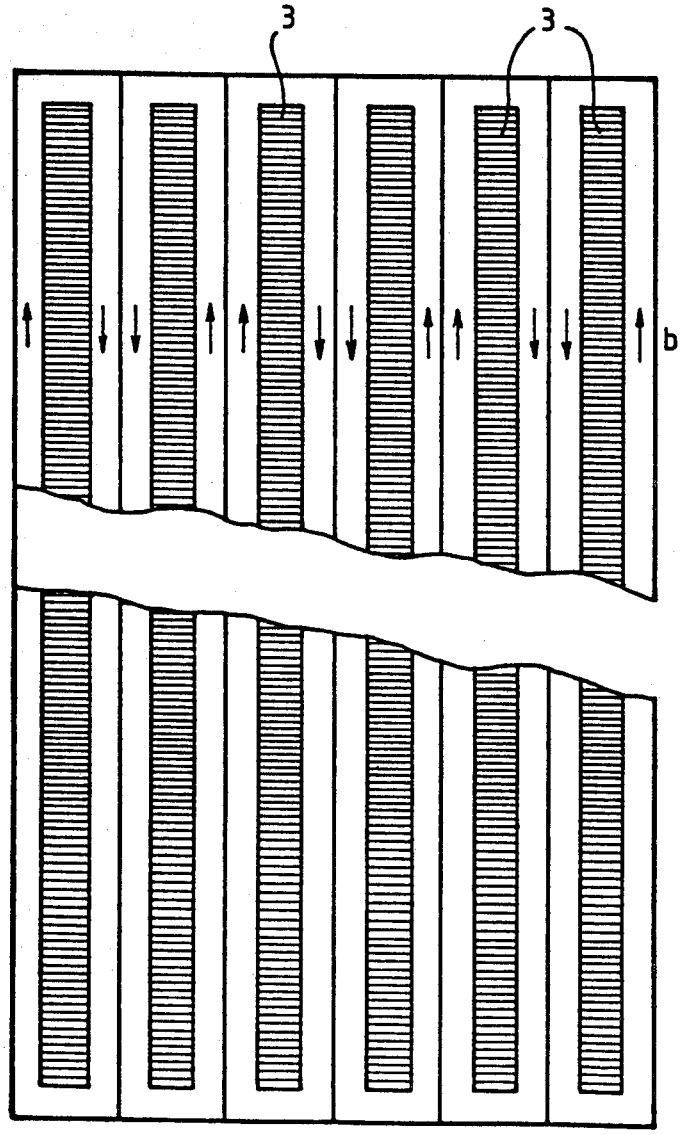
FIGS. 6 and 7 are plan views of a form of the embodiment of an inductor adapted to the heating of strip, respectively without the product and with the product.
Figure 7:
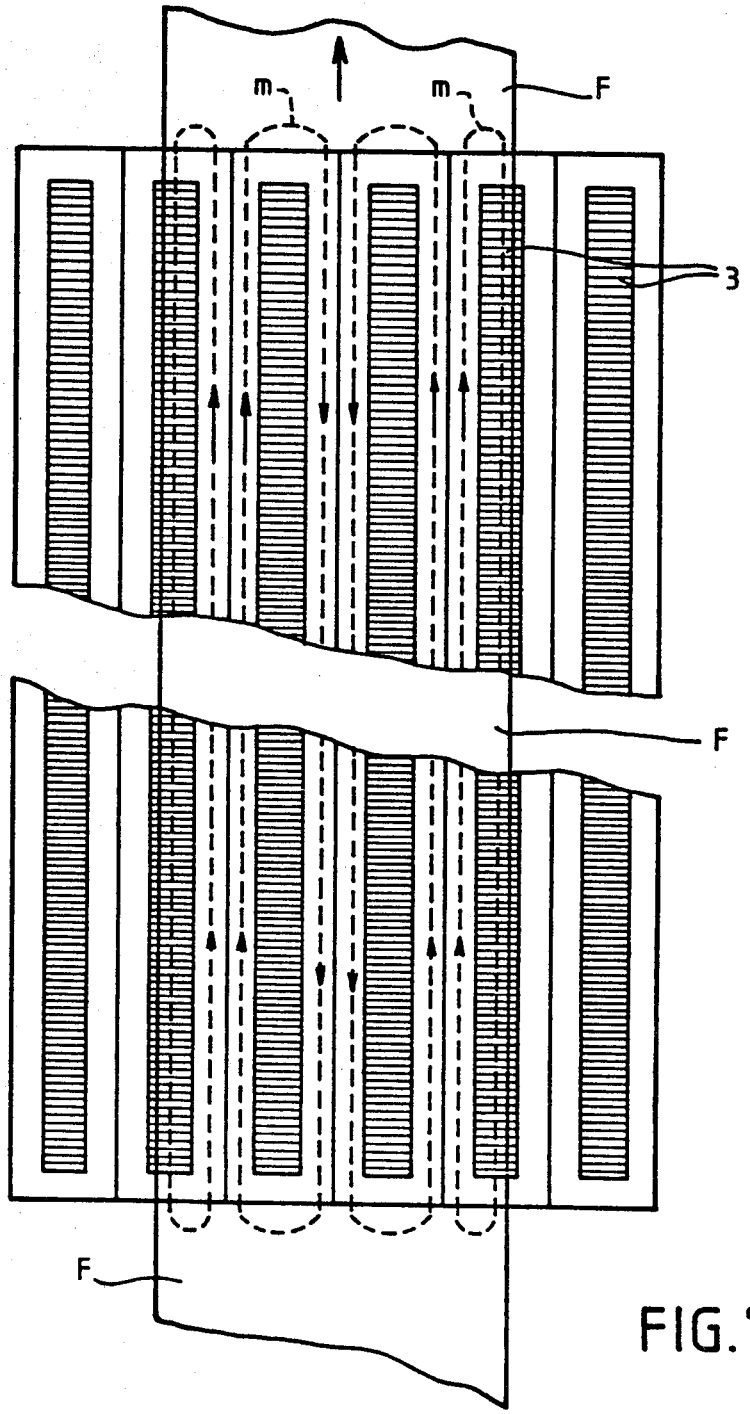

In a form of embodiment of the invention more adapted to the heating of strip, the inductors consist of poles (3) of an elongated configuration (FIGS. 6 and 7), which, at a given instant, are alternatingly north and south.

Figure 8:
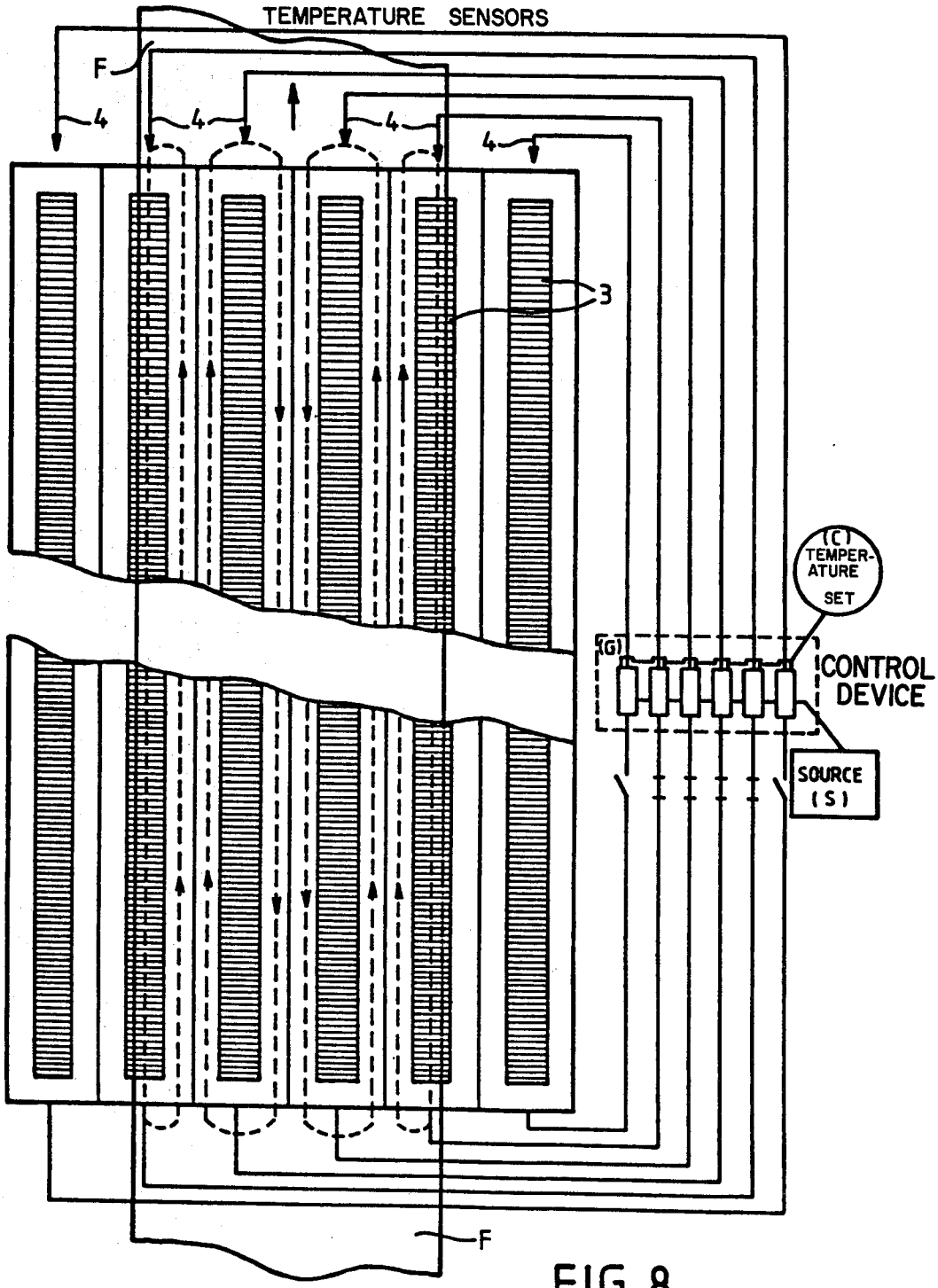
FIG. 8 is a diagram functionally illustrating controls appropriate to the form of embodiment of FIGS. 6 and 7.

At the outlet of the inductors (FIG. 8) a temperature sensor (4) placed to face each of the poles, permits the regulation of the current of the corresponding pole as a function of an assigned temperature (C). In this manner, variations in the width and the position of the product (F) are taken into account implicitly. Poles which do not face the product are extinquished (deenergized).

As an alternative to using temperature sensors to sense the actual product temperature at each transverse pole location, a computer may be used to determine the different current intensities required to obtain a correct transverse heating profile and, in response to a single temperature sensor and the computed intensity required for the profile, the total level of current intensities may be controlled.

In a preferred form of embodiment, the products treated are rectangular. The length and the width of the product are inputs in the principal computer. As the principal axis of the product is preferably parallel to the heating device, knowledge of the position of one of the points of the product, for example the center, with respect to the heating device makes it possible to determine completely the position of the product (particularly that of its boundaries) with respect to the inductor.

For this purpose, upon its arrival, the product is placed symmetrically with respect to the two perpendicular axes known. The displacement of the product is effected by the successive extinction of rows of adjacent transverse poles, thus step by step, by a distance equal to a polar step. The computer is incremented at each extinction and thereby yields the position of the center at each instant.

The increase in temperature is known, for example, by the integration as a function of time of the ratio of power per unit volume (determined by the computer) to the specific heat. It may be verified by measuring the temperature of the product with a contact thermometer.

It should be understood, finally, that the present invention has been described and illustrated only in connection with preferred examples and that equivalent substitutions may be made in its constituting elements without otherwise departing from the scope of the invention.

What is claimed is:

1. Process for the heating by transverse flux electromagnetic induction heating of stationary flat and thin conducting products of variable dimensions, in order to obtain in particular temperature homogeneity in both the transverse and the longitudinal direction, at the boundaries and in the rest of the product, the process comprising the steps of:

generating in the product in two directions a plurality of currents forming elementary current arrays by means of a matrix arrangement of conductors disposed in plural columns and plural rows;

defining arrays of local heating heterogeneity each comprising at least one of said elementary arrays; and controlling the intensity of each of said plurality of currents as a function of the volume of the array of local heating heterogeneity to which they correspond, so that the average value of power dissipated per unit volume is substantially the same magnitude in each array of local heating heterogeneity.

2. A heating process according to claim 1 wherein each array of local heating heterogeneity comprises only one elementary array.

3. A heating process according to any one of claims 1 or 2, including the steps of:

generating an alternating magnetic field with at least one inductor composed of conductors forming current loops; and controlling the current intensities passing through the conductors, at least in part independently of each other, the regulation of one with respect to the others being a function of at least one of the dimensions of the product.

4. A heating process according to claim 3 including the steps of:

determining the position of the product with respect to the inductor and, in particular, the position of its boundaries;

defining the rise in temperature to effected;

determining the temperature of the product;

computing the value of the current intensities to be circulated in the different current loops of the inductors as a function of predetermined characteristics of the product and the heating desired;

regulating, based on the current intensity values calculated and by means of a source the frequency whereof may be variable, the current intensities in each current loops or group of current loops of the inductor.

5. Apparatus for the heating of conductive, stationary flat and thin products by alternating transverse flux electromagnetic induction in order to obtain temeprature homogeneity both in the transverse and the longitudinal direction, at the boundaries as well as in the rest of the product, said apparatus comprising:

a magnetic circuit made up of at least one inductor including a matrix arrangement of conductors disposed in plural columns and plural rows and forming a lattice of current loops of identical dimensions distributed in two orthogonal directions;

means for monitoring the position of the product with respect to the inductor and, in particular, the position of the boundaries;

means for defining the rise in temperature of the product to be effected;

means for monitoring the temperature of the product;

means connected to the monitoring and defining means to determine the current intensities to be circulated in the current loops of the inductor as a function of the product and of the heating desired;

means for generating the currents in said current loops at the intensities so determined.

6. Apparatus according to claim 5 including means for measuring the temperature of the product and associated means for regulating the current intensities passing through the inductor as a function of a predetermined temperature setting and the measured temperature.

7. Apparatus according to claim 5 including:

means for monitoring the position of the product with respect to the conductors;

a device for regulating the current intensities passing through the conductors;

a computer connected with the preceding means and computing, as a function of the characteristics of the product and its position, control data to be entered in the regulating device.

8. Apparatus according to claim 7 including at least one means for measuring the temperature of the product and one temperature setting device both connected to the computer.

9. Apparatus according to claim 7 including at least one function generator for generating a desired temperature function of the product with respect to time, the computer using said function to develop input parameters for the regulating device.

10. Apparatus according to claim 9 including at least one temperature measuring means for measuring actual product temperature connected to the computer, the computer controlling the rise in temperature in the product in response to at least said temperature measuring means.

11. Apparatus according to claim 5 wherein the product is supported electromagnetically.

12. Apparatus according to claim 11 wherein the product is maintained electromagnetically in at least one horizontal direction by means of spatial variations of the magnetic field.

13. Apparatus according to claim 12 wherein the product is electromagnetically propelled horizontally.

* * * * *